United States Patent [19]

Harmony, III

[11] 4,074,370

[45] Feb. 21, 1978

[54] BATHING APPARATUS FOR HOSPITAL OR BEDRIDDEN PATIENTS

[75] Inventor: George W. Harmony, III, Marion, Va.

[73] Assignee: Mediglas, Inc., Charlotte, N.C.

[21] Appl. No.: 673,290

[22] Filed: Apr. 2, 1976

[51] Int. Cl.[2] ..... A47K 3/0; A47K 3/022

[52] U.S. Cl. ..... 4/173 R; 4/176; 128/369

[58] Field of Search ..... 4/185 L, 185 R, 173 R, 4/173 M, 176, 177, 179, 183, 185 HB, 185 S, 166, 167; 128/369

[56] References Cited

U.S. PATENT DOCUMENTS

| | | | |
|---|---|---|---|
| 1,723,981 | 8/1929 | Garcia | 4/179 |
| 1,941,832 | 1/1934 | Gottfried | 4/179 |
| 2,560,997 | 7/1951 | Thompson | 4/185 L |
| 2,798,229 | 7/1957 | McQuown | 4/179 |
| 2,850,743 | 9/1958 | White | 4/185 L |
| 3,407,411 | 10/1968 | Stevens | 4/185 R |
| 3,477,069 | 11/1969 | Stiger | 4/185 L |
| 3,969,776 | 7/1976 | Gildea | 4/185 HB |

*Primary Examiner*—Henry K. Artis

[57] ABSTRACT

A relatively shallow fiberglas, or other sturdy but lightweight material, tub is provided with legs and lockable casters to be easily portable. The tub itself is of such size and shape as to enable usage by adults, while the legs support the tub with the upper edge thereof on substantially the same level as the surface of the hospital bed with which it is used. A back rest is removably positionable to the tub edge at one end thereof to provide further support for invalid patients. A drain pump is connected to the drain outlet for pumping water from the tub into sinks or over barriers of higher elevation. A thermostatically controlled heating element is embedded in the tub surface for keeping the water at a desired safe, warm temperature.

5 Claims, 4 Drawing Figures

BATHING APPARATUS FOR HOSPITAL OR BEDRIDDEN PATIENTS

BACKGROUND OF THE INVENTION

In hospitals and other such institutions there is no adequate provision in existance for bathing bedridden patients. Either they must be transported to a bathroom elsewhere in the hospital for baths, at which time it is very difficult to get them in and out of the bathtub, or else they must merely be given sponge baths while remaining in the bed. There has therefore been recognized a need for some type of portable bathing apparatus which can be wheeled alongside the bed and used more easily than previously known techniques. Further, the apparatus should be so designed and built as to permit easy movement of the patient thereinto, regardless of the patient's condition.

In this regard one problem arises in that, for optimum satisfaction, the ideal height for such a bathing apparatus would be such that the upper edge of the tub is on substantially the same level as the surface of the hospital bed with which it is used. The problem exists in that it is generally necessary to drain the tub into existing sinks and plumbing fixtures, which are generally 4 to 6 inches higher than the conventional bed level. Therefore, some type of emptying means is required if the bathing apparatus is to be maintained at the bed level.

Another problem exists in keeping the water temperature at a desired warm level. If the tub is filled elsewhere in the hospital and wheeled into the patient's room, the time lapse can cause the water temperature to drop below a desired level. Several approaches have been considered which would alleviate this situation. For example, a cover could be provided; a filling conduit could be provided so that the tub is filled right beside the patient's bed from the sink which is generally available in most hospital rooms; however, in the preferred solution some type of thermostatically controlled heating element is embedded in the walls of the tub to maintain the temperature at a desired safe level regardless of the filling technique utilized.

Toward this end, there is hereby provided a bathing apparatus for hospital or bedridden patients which includes a relatively shallow tub portion formed from fiberglas or other sturdy, but lightweight, material which is reinforced to be capable of supporting four hundred pounds; and of such size and shape as to enable usage by adults in at least a sitting position. The tub is provided with a removable back rest and legs having lockable casters on the lower end thereof to make the tub portable. The tub and legs may be molded as a unitary structure, or preferably the legs are molded separately and attached to the tub member by suitable hardware. The legs are of such length that when connected to the tub, the upper edge of the tub is on substantially the same level as the hospital bed with which it is used. A drain pump is connected to the drain outlet in the tub portion for pumping water from the tub to or over higher elevations such as sinks and the like. Finally, if desired, a thermostatically controlled heating element may be embedded in the tub surface and/or walls for keeping the water at a desired temperature.

It is therefore an object of the present invention to provide a portable bathing apparatus for hospitals or institutions.

It is further an object of the present invention to provide such a portable apparatus that facilitates easy movement of a patient from the bed into the tub alongside.

A further object of the present invention is to provide a portable bathing apparatus of the type described with a means for emptying the tub and transporting the drained water to places of higher elevation.

A still further object of the present invention is to provide a portable bathing apparatus of the type described which includes a heating element embedded in the tub for maintaining the water at a desired temperature.

Other objects and a fuller understanding of the invention will become apparent upon reading the following description of a preferred embodiment along with the accompanying drawings, in which.

DETAILED DESCRIPTION OF A PREFERRED EMBODIMENT

Figure 1:
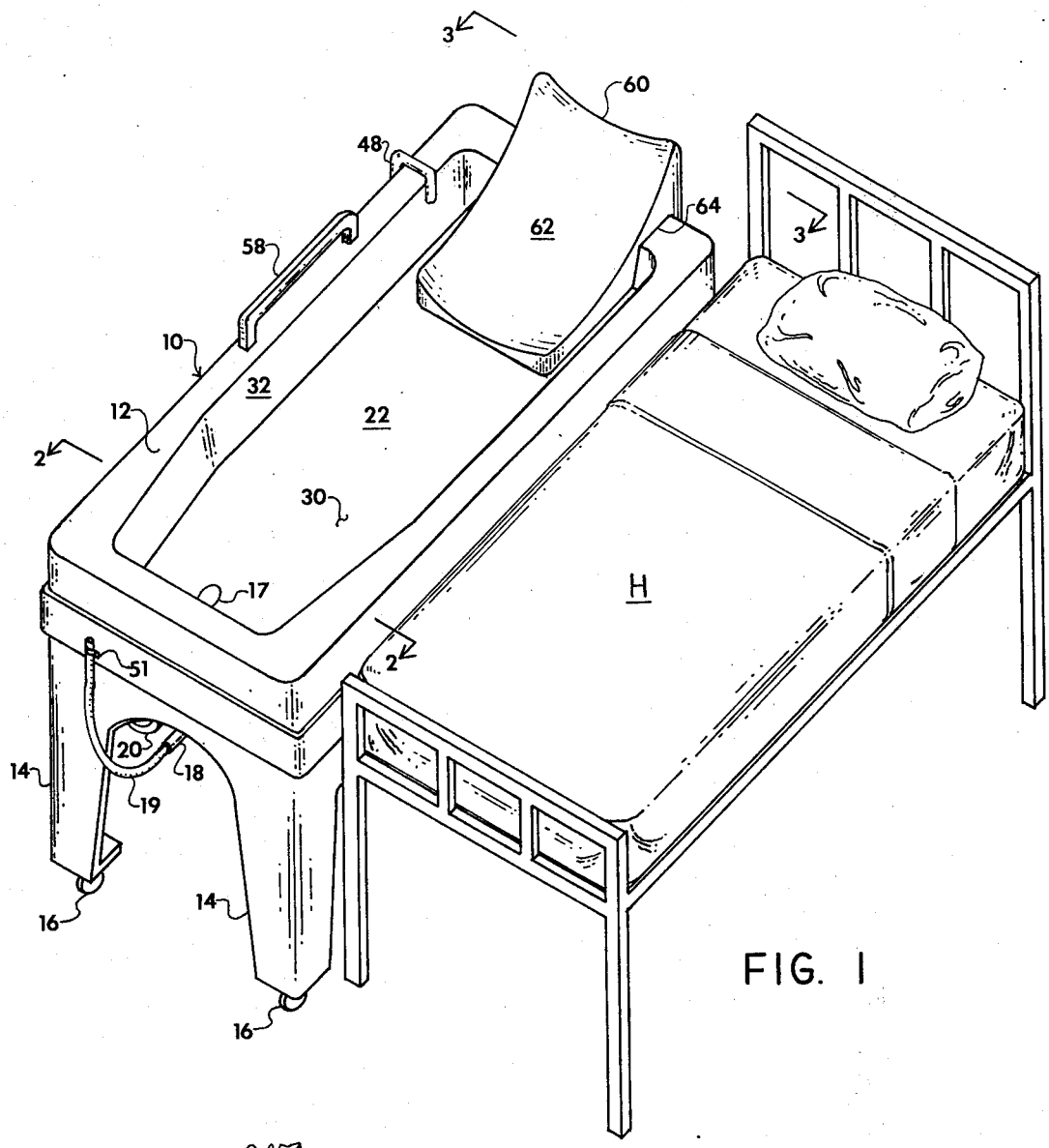
FIG. 1 is a perspective view of the bathing apparatus according to the present invention in use next to a conventional hospital bed.

Turning now to the drawings, there is illustrated in FIG. 1 the portable institutional bathing apparatus 10 which is removably positionable beside a hospital bed, generally indicated at H. The apparatus 10 includes a tub portion 12 and a plurality of legs 14 or leg frames depending from the corners of said tub portion 12 and including lockable casters 16 on the lower ends thereof.

Figure 2:
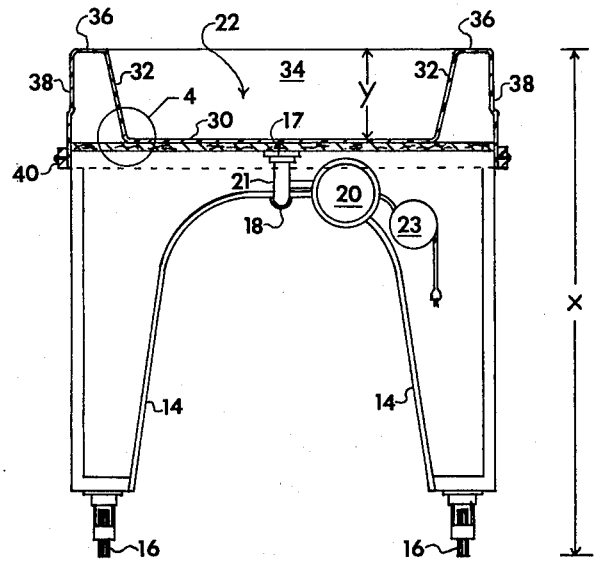
FIG. 2 is a transverse sectional view taken substantially along lines 2—2 in FIG. 1.

A water drain conduit means 18 communicates with the interior of the tub for removing water therefrom and toward this end includes a flexible hose 19 attached to the outlet end thereof through which water leaves the tub and can be emptied. Pump means 20 is operatively connected to the aforesaid drain conduit 18 for pumping water from said tub portion to places of higher elevation for disposal. Bathing chamber 22 is molded into the upper surface of tub portion 12 of such dimensions as to comfortably receive an adult human body. The height $x$ (FIG. 2) of the tub from the ground or floor is substantially the same as the height of conventional hospital beds H with which it is used. A back rest 60 includes a sloping surface 62 rising from the bathing chamber 22 and having a means for releasably attaching the back rest to the side wall of tub portion 12.

A separate filling hose 48 is provided for introducing water into the bathing chamber 22, and the other end (FIG. 3) includes an attaching adapter 44 whereby the filling hose 48 may be releasably attached to a water faucet for filling of the bathing chamber 22. If desired, a thermostatically controlled heating element 49 may be embedded within the surface 30 of the bathing chamber 22 to control the temperature of the water therein within prescribed safe limits.

The tub portion 12 is preferably molded as a separate component from fiberglas or other sturdy but lightweight moldable material covered with a conventional gel coating (not shown), and includes a bathing chamber 22 molded into the upper surface thereof. Bathing chamber 22 includes a bottom surface 30, side walls 32, and end walls 34. Side walls 32 and end walls 34 curve upwardly over an upper edge 36 and downwardly to form outer side walls or a skirt 38 to which the legs 14 or leg frames are attached by means of conventional attaching means 40.

Bathing chamber 22 is of such size and dimension as to receive a human body comfortably therein. In this regard, the length and width of bathing chamber 22 are approximately 5 feet long by 2½ feet wide, which is approximately the size of a conventional bath tub. However, it should be noted that the height of side walls 32 and end walls 34 are significantly less than a conventional bath tub, so that a patient may be more easily placed thereinto and removed therefrom, overcoming one of the problems with the prior art bath tubs.

Toward this end, the depth y (FIG. 2) of the bathing chamber is approximately 6 to 8 inches, thereby providing sufficient depth to retain a substantial amount of water without splashing out during the bathing process; however, allowing nurses and orderlies to easily position and remove patients into and from the tub. Further a hand rail 58 is provided on the tub side opposite the side moved into position alongside the bed.

A reinforcing plate 54 or layer of plywood, particleboard, or other similar material is emplaced beneath the bottom wall 30 of the bathing chamber 22, so that the tub is adapted to support loads of up to 400 pounds without rupture or damage. A coating 56 of fiberglas is sprayed or painted on the underside of reinforcing sheet or plate 54.

Pump 20 includes a fitting 21 which is inserted between the drain opening 17 and the drain conduit 18 and provided with an on/off switch (not shown), so that when the pump is activated the water is forced through flexible hose 19 to be deposited wherever desired. It should be noted that hospital bed heights are generally several inches below the standard height of sinks, and therefore some type of pumping means has to be provided if the tub level is to be maintained at the bed height. A spring loaded reel 23 permits the electrical conduit for the pump to be maintained beneath the table out of the way and yet pulled out for installation when desired. Spring clip 51 maintains the free end of hose 19 in a stored position until it is desired to be used.

Figure 3:
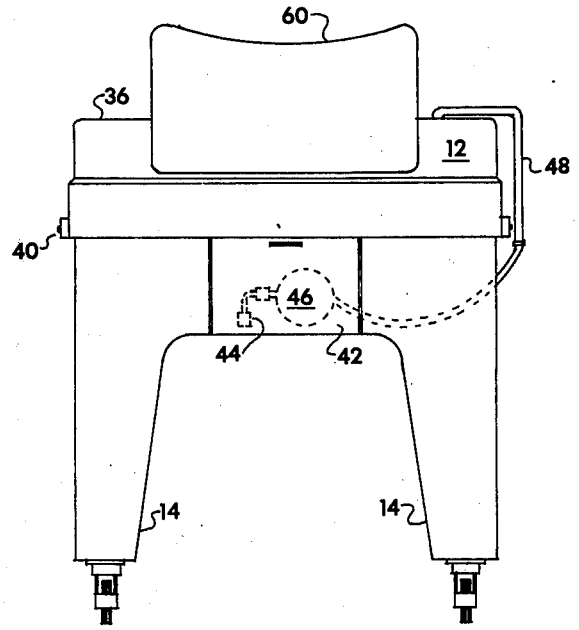
FIG. 3 is an end view taken substantially along lines 3—3 of FIG. 1.

Looking now at the other end of the bathing apparatus 10 in FIG. 3 there is shown a hinged cover 42 which is normally held closed by magnetic door latches; however, may be selectively lowered to expose the connection for filling hose 48 which includes a nozzle adapter 44 so arranged as to fit onto a water faucet much in the same manner as a portable dishwasher. The filling hose 48 is mounted on a spring loaded reel 46 so that the adapter 44 and hose 48 may be maintained beneath the table, yet pulled out when desired for installation.

Back rest 60 includes a sloping support surface 62 which rises at an angle from the tub surface 22 to a height above the upper edge 36 of end wall 34. An inverted U-shaped groove 64, approximately the same size and shape as end wall 34 and upper edge 36, allows the back rest 60 to be easily snapped onto and off the end wall of tub 22.

Figure 4:
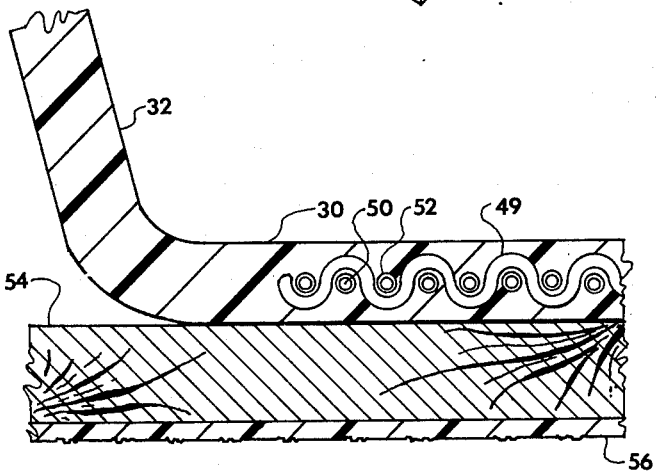
FIG. 4 is an enlarged cross-sectional view of the portion of the tub surface indicated in FIG. 2.

In FIG. 4, there is illustrated a large cross-sectional view of the tub surface 30 which includes therein a thermostatically controlled electrical heating element 49 selected from any of several suitable types of heating elements. For example, in the embodiment illustrated, a wire mesh with crisscrossing electrical wires 50 as illustrated. For safety purposes each wire is surrounded by sufficient insulation 52 so that there is no danger of water getting to the electrical wire. Wires 50 are connected in a conventional manner to a power source and provided with a conventional thermostat control to maintain a safe warm water temperature.

Although a preferred embodiment has been shown and illustrated hereinabove, it should be recognized that various changes and modifications could be made without departing from the scope of the invention which is to be limited only by the following claims.

What is claimed is:

1. A portable institutional bathing apparatus for use beside a hospital bed comprising:

a. a tub portion including:

i. a molded bathing chamber formed of a strong, lightweight, moldable material covered with a gel coating and having a bottom wall and a relatively shallow side and end walls;

ii. a skirt substantially surrounding said molded bathing chamber and depending from the upper edge of said side and end walls and extending downwardly a distance greater than the depth of said side and end walls;

iii. a reinforcing plate secured to and extending between the opposite sides and ends of said skirt in supporting relation to the undersurface of said bottom wall;

b. a leg frame attached to and supporting said tub portion and including a plurality of legs with casters at the lower extremities thereof;

c. a drain opening in said bottom wall in communication with a drain conduit means, and a pump in operative communication with said drain conduit for depositing drain water where desired, even to locations of higher elevation; and d. an extensible fill hose means separate from said drain conduit means and mounted on said apparatus having an outlet into said bathing chamber and means at the opposite end for connection to conventional available faucets, whereby fill water is introduced directly from institutional plumbing into said bathing chamber.

2. The bathing apparatus according to claim 1 and further including a thermostatically controlled heating element embedded within the surface of said bathing chamber and having means for selectively and releasably connecting said heating element to a source of electric power, whereby said heating element may be activated to maintain water temperature within said bathing chamber at a desired level.

3. The bathing apparatus according to claim 1 wherein said material is fiberglas.

4. The apparatus according to claim 1 wherein said drain conduit means includes an inlet communicating with said drain opening of said tub portion, an outlet having a flexible hose attached to the downstream side thereof, a T-shaped pipe fitting having said pump means attached to the free end of the leg thereof, and the crossbar of said T-shaped fitting interposed between said inlet and an outlet.

5. The apparatus according to claim 1 further including a removable back rest, and means for releasably attaching said back rest to one end of said tub portion.

* * * * *